US005113686A

United States Patent [19]

Kawahara

[11] Patent Number: 5,113,686

[45] Date of Patent: May 19, 1992

[54] ZERO-TOLERANCE DIE LOCATION PIN

[75] Inventor: Tsutomu Kawahara, Southgate, Mich.

[73] Assignee: Mazda Motor Mfg. (USA) Corp., Flat Rock, Mich.

[21] Appl. No.: 628,508

[22] Filed: Dec. 14, 1990

[51] Int. Cl.[5] ..... B21D 37/14

[52] U.S. Cl. ..... 72/462; 72/481; 100/918; 83/640

[58] Field of Search ..... 72/446, 462, 481, 482; 100/918; 83/387, 640; 269/47

[56] References Cited

U.S. PATENT DOCUMENTS

| | | | |
|---|---|---|---|
| 4,520,919 | 6/1985 | Keitaro | 72/462 |
| 4,738,130 | 4/1988 | Homma | 72/481 |
| 4,912,960 | 4/1990 | Kroener et al. | 72/462 |

FOREIGN PATENT DOCUMENTS

| | | | |
|---|---|---|---|
| 248317 | 8/1987 | Fed. Rep. of Germany | 72/481 |
| 63-138926 | 9/1988 | Japan . | |
| 180067 | 2/1966 | U.S.S.R. | 72/481 |

*Primary Examiner*—David Jones
*Attorney, Agent, or Firm*—Thompson, Hine and Flory

[57] ABSTRACT

A die location pin to be used with a die of the type having a pin recess and shaped to be mounted on an associated bolster having a complementary pin recess. The pin includes a central shaft which supports a slide member engaging upper and lower resilient members positioned in the die and bolster recesses, respectively. Upper and lower collar members are fixed relative to the die and bolster and engage the upper and lower resilient members on sides opposite of that engaged by the slide member. The die includes a shoulder which, when the die is placed upon the bolster, engages a shoulder of the slide member to urge the slide member downwardly such that the upper and lower resilient members are compressed against the upper and lower collar members, respectively, thereby forcing the resilient members to expand radially outwardly to eliminate clearance between the pin and pin recess in the die and bolster in order to provide a more precise pin location function.

17 Claims, 2 Drawing Sheets

ZERO-TOLERANCE DIE LOCATION PIN

BACKGROUND OF THE INVENTION

The present invention relates to location pins and, more particularly, to location pins used to orient a stamping die on a bolster.

In order to perform a high-quality stamping process it is necessary to align the male and female die components relative to each other with high precision. This requires that the die components be located on their respective bolsters with high precision. Further, to maintain such high precision over repeated stamping operations, it is necessary that the die components not vary from the locations determined when the dies are first attached to their respective bolsters.

In order to effect proper placement of dies upon bolsters, location pins are used. Typically, a location pin is precision ground and located within complementary pin recesses formed in the die and bolster. However, in order to facilitate mounting of the die upon the bolster, especially in situations when the die may be juxtaposed to the bolster in a slightly skewed relation during mounting, it is necessary to provide a clearance between the location pin and the die and bolster pin recesses within which it is mounted. Such a clearance is on the order of 1.1 to 1.5 mm for the pin and die, and 0.3 to 0.5 mm for the pin and bolster. With such clearances, movement of as much as 2.0 mm may occur, which is unacceptable. As a result of these clearances, it is necessary to bolt the die into place after it is mounted upon the bolster in order to prevent slight movement of the die during a stamping operation.

An example of such a mounting mechanism is disclosed in Japanese Patent No. 63-138926. That patent discloses a die having a peripheral flange which is engaged by a lug which is pivotably attached to an associated bolster. The lug is pivoted into engagement with the die flange and is bolted to the bolster in order to clamp the die to the bolster. Typically, such a clamping mechanism is used in conjunction with location pins which provide a somewhat rough placement of the die.

A disadvantage with such die-mounting mechanisms is that they require additional labor and components for precise location of a die upon a bolster. Accordingly, there is a need for a mounting mechanism for precise location of a die upon a bolster which eliminates the need for mounting bolts, at least in instances where a lower die is mounted on top of a bolster.

SUMMARY OF THE INVENTION

The present invention is a die location pin having resilient members which expand radially outwardly under the weight of the die to eliminate any clearance between the pin and the recesses in the die and associated bolster. Accordingly, such a "zero-tolerance" condition results in a precise location of the die upon the bolster. In instances where the die is positioned on top of the bolster, the weight of the die causes the expansion of the resilient members so that the location pins alone are all that is required to maintain the die in a proper position.

In a preferred embodiment, the location pin includes a central shaft which slidably receives a slide member which contacts resilient members located along the shaft to be positioned within the recesses of the die and bolster. The shaft also receives upper and lower collar members which are positioned on the shaft to engage the resilient members on sides opposite that engaged by the slide.

A shoulder is formed in the die location pin recess so that when the die is placed upon the bolster, the shoulder of the die location pin recess engages the slide to displace it along the pin shaft and compress the resilient members against their respective collar members, thereby forcing the resilient members to expand radially outwardly against the interior walls of the pin recesses in the die and bolster. It is the expansion of these resilient members that eliminates the clearance between the pin and recesses.

In the preferred embodiment, the pin is shaped so that the expansion of the resilient members occurs only at the time of engagement between the die and bolster, so that there is sufficient clearance to allow for positioning the die relative to the bolster.

Accordingly, it is an object of the present invention to provide a location pin for a die which utilizes the weight of the die to expand radially outwardly and eliminate clearance between the pin and pin recesses of the die and bolster; to provide a location pin which effects location of the die upon the bolster with sufficient precision to eliminate the need for mounting bolts; and to provide a location pin which is rugged, durable and relatively inexpensive to manufacture.

Other objects and advantages will be apparent from the following description, the accompanying drawings and the appended claims.

DETAILED DESCRIPTION

Figure 1:
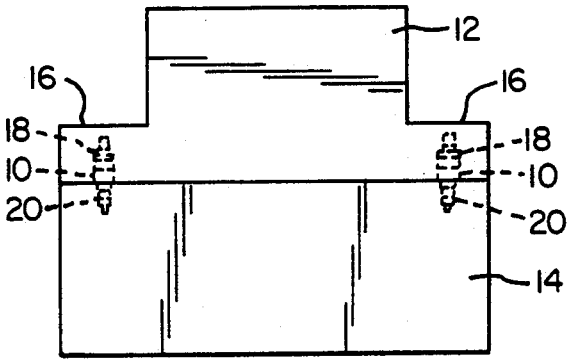
FIG. 1 is a side elevation of a die mounted upon a bolster, showing a preferred embodiment of the location pin of of the present invention in broken lines.

As shown in FIG. 1, the stamping die location pin, generally designated 10, is designed to be used to mount a stamping die 12 upon an associated bolster 14. The die 12 includes a peripheral flange 16 having location pin recesses 18 formed therein. Similarly, bolster 14 includes complementary location pin recesses 20 positioned in registry with the die location pin recesses 18.

Figure 3:
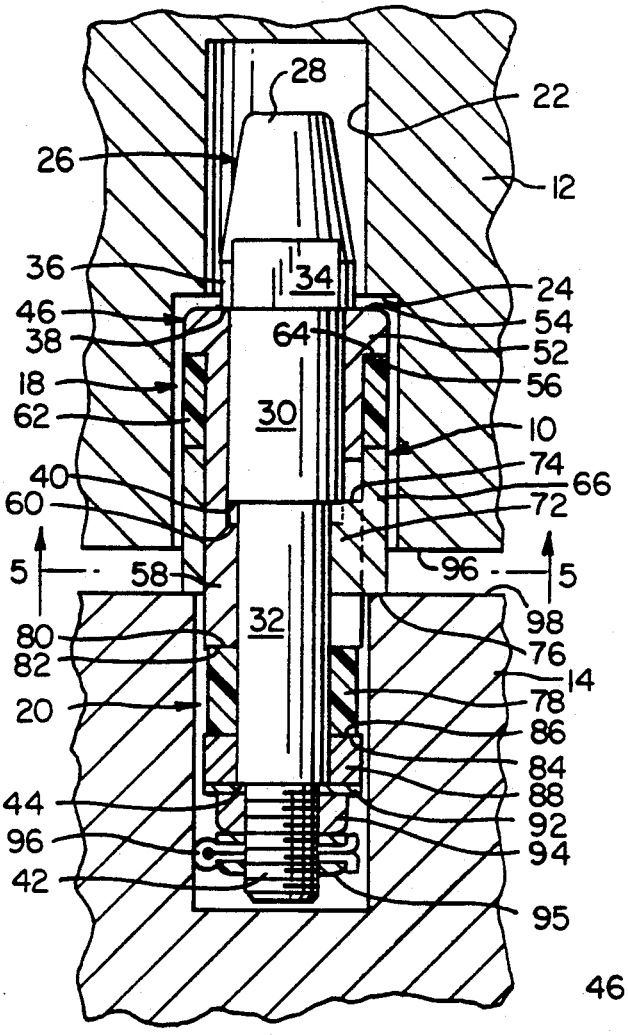
FIG. 3 is a detail of FIG. 1, showing the die and bolster in section, slightly separated, and showing the location pin in partial section.

As shown in FIG. 3, the die pin recess 18 includes a reduced diameter portion 22 forming a shoulder 24. Alternatively, a bushing or the like may be inserted in the recess 18 to provide shoulder 24.

Figure 2:
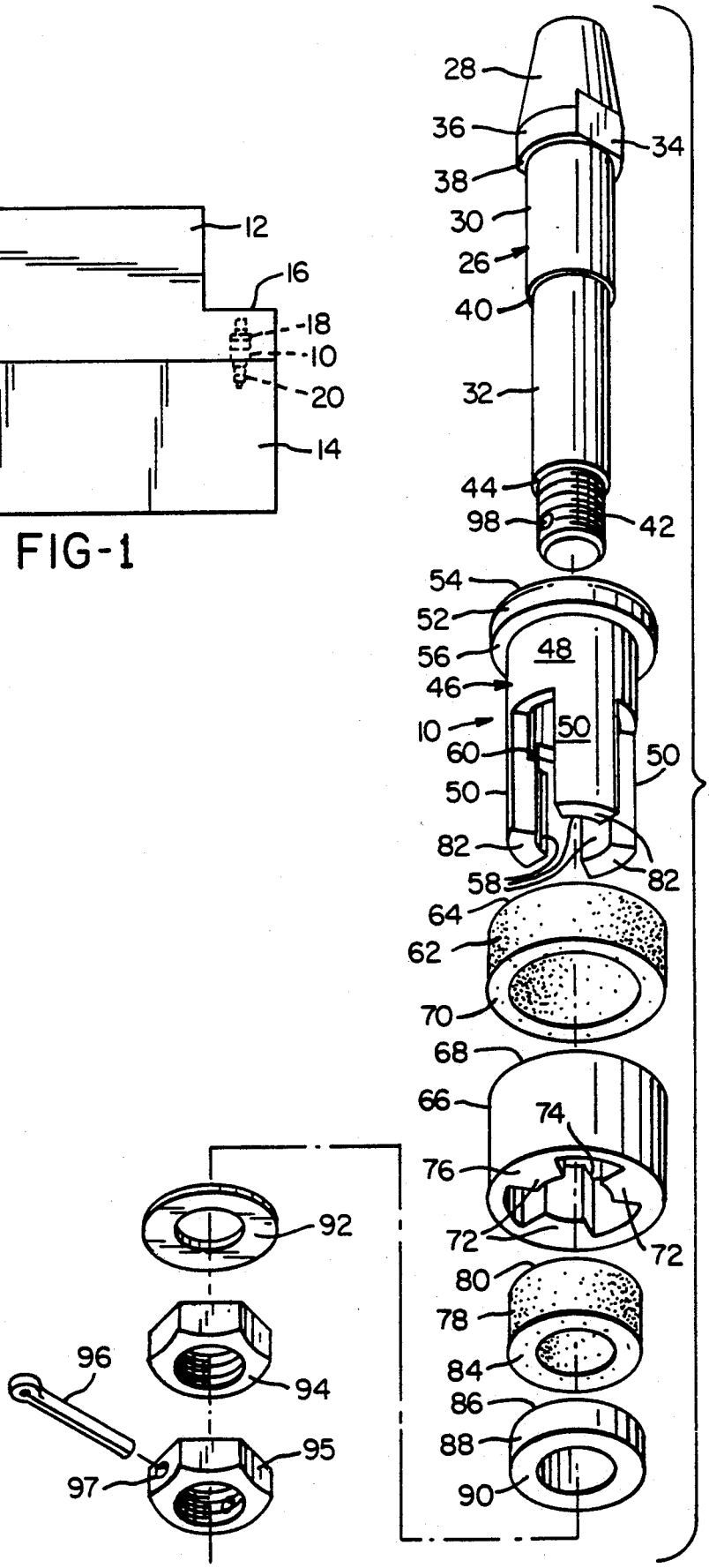
FIG. 2 is an exploded, perspective view of the location pin of FIG. 1.

As shown in FIGS. 2 and 3, the pin 10 includes a central shaft 26 having a head 28, upper segment 30 and lower segment 32. The head 28 is frusto-conical in shape and includes flats 34 ground on its side to facilitate grasping by a wrench or pliers. The head 28 terminates at a lower end in a cylindrical segment 36. The upper segment 30 is of reduced diameter with respect to the cylindrical segment 36, thereby forming an undercut 38.

The lower segment 32 is of reduced diameter with respect to upper segment 30 thereby forming an undercut 40 with the upper segment. The lower segment 32 terminates at a lower end in a threaded shank 42 having a diameter reduced from the remainder of the lower segment, thereby forming undercut 44.

A slide member 46 slidably engages the central shaft 26 and includes a cylindrical segment 48 and three legs 50 extending downwardly from the cylindrical segment. The cylindrical segment 48 includes an annular crown 52 having an upper shoulder 54 and a lower lip 56.

Figure 5:
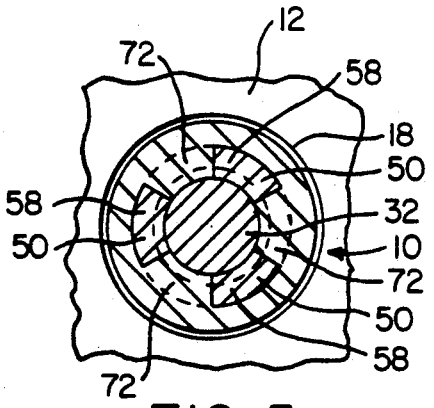
FIG. 5 is a section of the pin taken at line 5—5 of FIG. 3.

As shown in FIGS. 2, 3 and 5, each of the legs 50 is arcuate in section and includes a radially inwardly-extending lug 58 at its lower end which forms an upwardly-facing shoulder 60 with the remainder of the leg. The cylindrical segment 48 and upper portions of the legs 50 are sized to slide over the upper segment 30 of the central shaft 26. the lugs 58 of the legs 50 are sized to slidably engage the lower segment 32 of the central shaft.

An annular upper resilient member 62, preferably made of urethane, is sized to slidably engage the cylindrical segment 48 of slide member 46. The upper surface 64 of resilient member 62 engages the lip 56 of the crown 52.

A cylindrical upper collar member 66 is sized to slidably engage the outer surface of the slide member 46 and includes an upper surface 68 which abuts the lower surface 70 of the upper resilient member 62. The upper collar member 66 includes arcuate, radially inwardly-extending bosses 72 in a lower portion thereof which, as shown in FIGS. 2 and 3, form shoulders 74 that engage the undercut 40 on the central shaft 26. The upper collar member 66 terminates in a lower surface 76 which has a diameter greater than that of the recess 20. The bosses 72 are arcuate and shaped to slidably engage the lower segment 32 of the central shaft 26, and are spaced to receive the legs 50 of the slide member in slidable engagement, as best shown in FIG. 5.

An annular lower resilient member 78 is sized to slidably engage the lower segment 32 and includes an upper surface 80 which contacts the lower surfaces 82 of the legs 50. The surface 84 of the lower resilient member 78 engages the upper surface 86 of a lower collar member 88. The lower collar member 88 is annular in shape and sized to slidably engage the lower segment 32 of the central shaft 26.

The lower surface 90 of the lower collar member 88 engages a retaining washer 92 which is held in place by a pair of retainer nuts 94, 95 mounted on the threaded shank 42 of the central shaft 26. The retaining washer 92 also abuts undercut 44 on shaft 20. In order to prevent nuts 94, 95 from loosening after they are mounted on shank 42, a split pin 96 is inserted in holes 97, 98 in the nut and shank, respectively. Consequently, collar member 88 is prevented from displacement downwardly along shaft 26 by washer 92.

As shown in FIG. 3, the distance between the shoulder 54 of the slide member 46 and the lower surface 76 of the upper collar member 66 is greater than the depth of the die recess 18 from the underside 99 of the die 12 to the recess shoulder 24. In addition, the distance from the top surface 100 of the bolster 14 to the bottom of the bolster recess is greater than the distance from the lower surface 76 of the upper collar 66 to the bottom of the threaded shank 42. Consequently, when inserted in the bolster recess 20, the pin 10 is suspended in the recess by engagement of the upper collar member 66 with the upper surface 100 of the bolster 14.

The operation of the pin 10 is as follows. As shown in FIG. 3, the pin 10 is first placed in the bolster recess 20 so that the upper collar member 66 rests upon the upper surface 100 of the bolster 14, leaving the slide member 46, resilient member 62 and head 28 protruding upwardly from the bolster. The lower resilient member 78, lower collar 88 and a lower portion of shaft 26 are within bolster recess 20. The die 12 is then lowered upon the bolster with the die recess 18 positioned roughly in registry with the pin 10. The frusto-conical shape of the head 28 facilitates placement of the die 12 upon the bolster 14. The pin 10 is sized such that, at this time, there exists clearance between the pin and the recesses 18, 20. Such clearance is on the order of 2 mm.

As the die 12 is lowered upon the bolster 14, the shoulder 24 of the die recess 18 contacts the shoulder 54 of the slide member 46, urging it downwardly relative to the central shaft 26 and upper collar member 66. Shaft 26 is prevented from downward movement by engagement of the undercut 40 with the lugs 72 of the collar member 66 which, in turn, rests upon the upper surface 100 of the bolster 14. Consequently, lower collar member 88, which is fixed on the shaft 26, is prevented from moving as well.

Figure 4:
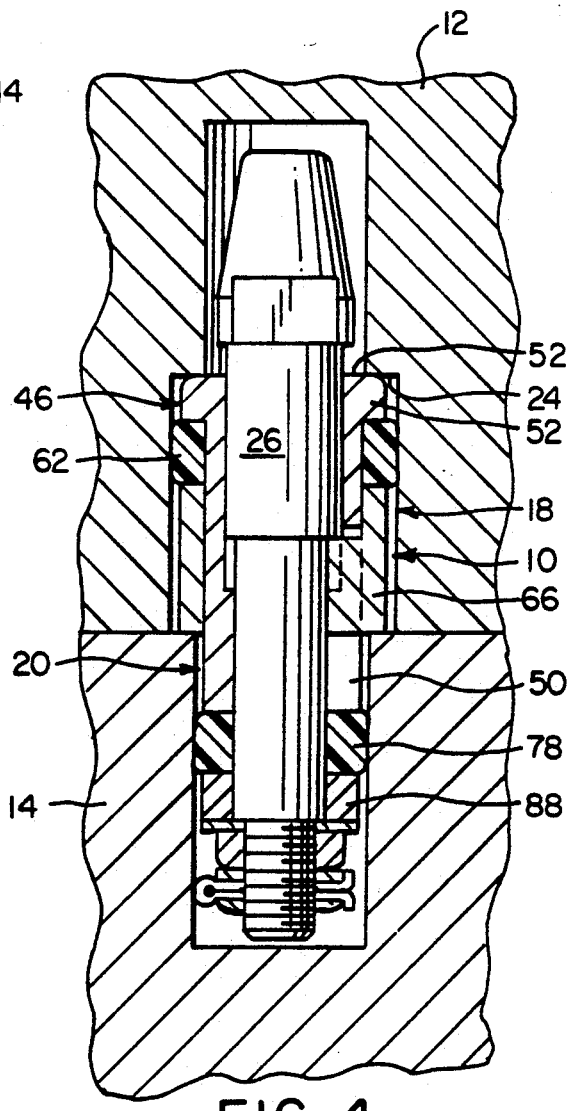
FIG. 4 shows the detail of FIG. 3 in which the die and bolster are placed in engagement with each other.

Downward movement of the slide member 46 causes the upper resilient member 62 to be compressed against the upper collar member 66, as shown in FIG. 4, which causes the resilient member to expand radially outwardly against the wall of the die recess 18. Similarly, the legs 50 of the slide member 46 compress the lower resilient member 78 against the lower collar member 88. This causes the lower collar member 78 to expand radially outwardly against the wall of the bolster recess 20.

When the die 12 contacts the bolster 14, the slide 46 has been displaced sufficiently to cause the upper and lower resilient members 62, 78, respectively, to expand radially outwardly to eliminate all clearance between the pin 10 and the die and bolster recesses 18, 20, respectively. Consequently, the pin 10 of the present invention provides a "zero-clearance" fitting which precisely locates the die 12 upon the bolster 14 and does not require mounting bolts to prevent movement of the die relative to the bolster during successive stamping operations. It is the downward weight force of the die 12 upon the bolster 14 that causes the expansion of the resilient members 62, 78; accordingly, further securement is not required.

In the preferred embodiment, the components of the pin 10 preferably are made of cold rolled steel with the exception of the resilient members 62, 78 which, as mentioned previously, are preferably made of urethane.

While the form of apparatus herein described constitutes a preferred embodiment of this invention, it is to be understood that the invention is not limited to this precise form of apparatus, and that changes may be made therein without departing from the scope of the invention.

What is claimed is:

1. For use with a die of the type having a location pin recess and shaped to be mounted on an associated bolster having a complementary location pin recess, a zero-tolerance location pin comprising:

an upper portion shaped to fit within said location pin recess with a first predetermined amount of clearance;

a lower portion shaped to fit within said complementary location pin recess with a second predetermined amount of clearance; and means responsive to and actuated by juxtaposition of said die and said bolster for expanding effective diameter of at least one of said upper and lower portions such that said clearances thereof are eliminated, whereby location of said die with respect to said bolster is made more precise.

2. The pin of claim 1 wherein said actuation means includes resilient means for expanding radially outwardly in at least one of said upper and lower portions to eliminate said clearances.

3. The pin of claim 2 wherein said die includes a shoulder in said location pin recess and said pin further comprises slide means, engaging said resilient means, having a complementary shoulder such that juxtaposition of said die and said bolster causes said shoulder to engage and displace said slide means relative to said upper and lower portions, thereby compressing said resilient means radially outwardly.

4. The pin of claim 1 wherein said resilient means includes upper and lower resilient members positioned on said upper and lower portions, respectively; said resilient members being expanded by said slide.

5. The pin of claim 4 further comprising collar means, contiguous with said resilient means, and positioned on a side of said resilient means opposite said slide means such that displacement of said slide means compresses said resilient means against said collar means, thereby expanding said resilient means radially outwardly to engage said pin recesses.

6. The pin of claim 5 wherein said collar means includes upper and lower collar members contiguous with said upper and lower resilient members, respectively.

7. The pin of claim 6 wherein said upper collar member is positioned to engage and be supported by said bolster.

8. The pin of claim 7 further comprising a central shaft slidably supporting said slide means, said upper and lower collar members and said upper and lower resilient members.

9. The pin of claim 8 wherein said central shaft includes means for retaining said lower collar member in juxtaposition with said lower resilient member.

10. The pin of claim 9 wherein said retaining means includes a pair of nuts threaded on said shaft.

11. The pin of claim 8 wherein said central shaft includes first stop means for limiting travel of said slide means along said shaft away from said upper resilient member.

12. The pin of claim 11 wherein said central shaft includes second stop means for limiting travel of said upper collar member toward said upper resilient member.

13. The pin of claim 12 wherein said slide means includes a cylindrical segment having said complementary shoulder and an annular lip shaped to engage said upper resilient member opposite said upper collar member; and a plurality of legs extending from said cylindrical portion axially along said central shaft to contact said lower resilient member opposite said lower collar member.

14. The pin of claim 13 wherein said upper collar member is shaped to slidably receive said legs therethrough and includes an annular upper surface engaging said upper resilient member, and an annular lower surface for engaging an upper surface of said bolster, whereby said upper collar member supports said pin in said bolster recess by engagement with said second stop means.

15. The pin of claim 14 wherein said upper collar member includes a plurality of bosses extending radially inwardly between said legs to engage said second stop means.

16. For use with a die of the type having a location pin recess with a shoulder formed therein, said die being mountable on an associated bolster having a location pin recess in registry with said die pin recess and having a diameter less than that of said die pin recess, a zero-tolerance location pin comprising:

a cylindrical central shaft having an upper portion shaped to fit within said die location pin recess and having first and second undercuts, and a lower portion shaped to fit within said bolster pin recess and terminating in a threaded end;

a slide member slidably mounted on said shaft, said slide member having an upper cylindrical portion including a shoulder shaped to engage said shoulder of said die recess and said first undercut and further including an annular lip, and a plurality of legs extending from said cylindrical portion axially along said shaft into said lower portion;

an annular upper resilient member slidably engaging said cylindrical portion and having an upper surface engaging said lip;

a cylindrical upper collar member shaped to slidably engage and receive said legs therethrough and having a plurality of lugs extending radially inwardly to engage said second undercut, an upper surface engaging said resilient member opposite said lip and a lower surface shaped to engage said bolster, such that said pin is supported in longitudinal position by engagement of said upper collar member with said bolster;

an annular lower resilient member slidably engaging said shaft lower portion and having an upper surface engaging said legs;

a cylindrical lower collar member slidably engaging said shaft lower portion and having an upper surface engaging a lower surface of said lower resilient member;

nut means mounted on said threaded lower end for retaining said lower collar member on said shaft;

said pin being sized to be received within said die and pin recesses with a non-zero clearance whereby juxtaposition of said die and bolster causes said die shoulder to engage said slide member shoulder and urge said slide member toward said bolster, thereby compressing said upper resilient member between said lip and said upper collar member and compressing said lower resilient member between said legs and said lower collar member such that said resilient members expand radially outwardly to remove clearance from between said pin and said die and bolster pin recesses.

17. For use with a die of the type having a location pin recess and shaped to be mounted on an associated bolster having a complementary location pin recess, a zero-tolerance location pin comprising:

an upper portion shaped to fit within said location pin recess with a first predetermined amount of clearance;

a lower portion shaped to fit within said complementary location pin recess with a second predetermined amount of clearance;

means actuated by juxtaposition of said die and said bolster for expanding effective diameter of at least one of said upper and lower portions such that said clearances thereof are eliminated, whereby location of said die with respect to said bolster is made more precise, said actuation means including resilient means for expanding radially outwardly in at least one of said upper and lower portions to eliminate said clearances;

said location pin recess including a shoulder; and slide means, engaging said resilient means, having a complementary shoulder such that juxtaposition of said die and said bolster causes said shoulder to engage and displace said slide means relative to said upper and lower portions, thereby compressing said resilient means radially outwardly.

* * * * *